US006902439B1

(12) United States Patent
Lee

(10) Patent No.: US 6,902,439 B1
(45) Date of Patent: Jun. 7, 2005

(54) WIRE CONNECT DEVICE FOR A BULB ASSEMBLY

(76) Inventor: Paul Son Lee, No. 18, Lane 557, Jhongjheng Rd., Wufong Township, Taichung County 413 (TW)

( * ) Notice: Subject to any disclaimer, the term of this patent is extended or adjusted under 35 U.S.C. 154(b) by 0 days.

(21) Appl. No.: 10/816,868

(22) Filed: Apr. 5, 2004

(51) Int. Cl.[7] ..... H01R 24/00
(52) U.S. Cl. ..... 439/699.2
(58) Field of Search ..... 439/699.2, 699.1, 439/660; 362/226, 294

(56) References Cited

U.S. PATENT DOCUMENTS 4,821,161 A * 4/1989 Koontz ..... 362/364
6,062,705 A * 5/2000 Zimmer et al. ..... 362/226
6,124,673 A * 9/2000 Bishop ..... 315/56
6,626,707 B2 * 9/2003 Henrici et al. ..... 439/699.2
6,830,473 B2 * 12/2004 Trainello ..... 439/416

* cited by examiner

*Primary Examiner*—Michael C. Zarroli
(74) *Attorney, Agent, or Firm*—Rosenberg, Klein & Lee

(57) ABSTRACT

A wire connect device includes a bulb seat having a body that has a screw shell and a plane formed opposite to the screw shell. A switch is mounted on the body and controls multiple electric elements in the body. Two connectors upwardly extend from the plane and are rectangular and parallel to each other for defining a groove. Two electrode plates extend into the groove and are electrically connected to the multiple electric elements. Each electrode plate has a sharpened free end allowing the electrode plates easily prick into the wire and electrically communicating with the cores in the wire. A fastener is mounted to the two connectors to hold the wire in place.

6 Claims, 7 Drawing Sheets

WIRE CONNECT DEVICE FOR A BULB ASSEMBLY

BACKGROUND OF THE INVENTION

1. Field of the Invention

The present invention relates to wire connecting device, and more particularly to a wire connect device for a bulb assembly.

2. Description of Related Art

A conventional wire connect device for a bulb assembly (60) in accordance with the prior art shown in FIGS. 6–8 comprises a connector (61) longitudinally extending from the bulb assembly (60) and multiple electric elements (not shown) mounted in the connector (61). A switch (62) is laterally mounted into the connector (61) and electrically connected to the electric elements for operating the electric elements. The bulb assembly (60) includes two electrode plates (65) upwardly extending therefrom and each having a sharpened free end.

The wire connect device includes a fastener (70) having a first end pivotally connected to a first side of the connector (61) and a second end selectively snapped to a second side of the connector (61). A cutout (63) is defined in the connector (61) for selectively receiving the second end of the fastener (70). The cutout (63) has two opposite sides each having a groove (64) laterally defined and communicating with the cutout (63).

The fastener (70) is L-shaped. The fastener (70) includes a horizontal section (71) having a first end pivotally connected to the first side of the connector (61) and a second opposite to the first end of the horizontal section (71). The horizontal section includes a cavity (74) defined therein and corresponding to the two electrode plates (65) of the bulb assembly (60), and a passage (73) longitudinally defined in the horizontal section (71) and laterally communicating with the cavity (74). A vertical section (72) extends from the second end of the horizontal section (71) and selectively received in the cutout (63) in the connector (61). The vertical section (72) has two buckles (75) respectively laterally extending from two opposite sides of the vertical section (72). The two buckles (75) are respectively snapped into a corresponding one of the two grooves (64) in the connector (61) when the vertical section (72) is received in the cutout (63) to hold the fastener (70) in place. A distance (L1) between the vertical section (72) and a shell (51) is smaller than a diameter of the wires (50).

The design of the electric elements in the connector must comply with safety requirements so that the depth of the cutout (63) is limited and shallow. As shown in FIGS. 7 and 8, the wires (50) are jammed and clamped between the fastener (70) and a liner of the shell (51) and turned about 90 degrees. However, the wire (50) has a regular rigidity so that insulation (not numbered) of the wire may be broken and cause a short circuit and/or reduce the ability of withstand to high pressure of electricity, also cause a temperature rise probably when the wire is overly turned.

The present invention has arisen to mitigate and/or obviate the disadvantages of the conventional wire connect device for a bulb assembly.

SUMMARY OF THE INVENTION

The main objective of the present invention is to provide an improved wire connect device for a bulb assembly.

To achieve the objective, the wire connect device in accordance with the present invention comprises a bulb seat having a body that has a screw shell and a plane formed opposite to the screw shell. A switch is mounted on the body and controls multiple electric elements in the body. Two connectors upwardly extend from the plane and are rectangular and parallel to each other for defining a groove. Two electrode plates extend into the groove and are electrically connected to the multiple electric elements. Each electrode plate has a sharpened free end allowing the electrode plates easily prick into the wire and electrically communicating with the cores in the wire. A fastener is mounted to the two connectors to hold the wire in place.

Further benefits and advantages of the present invention will become apparent after a careful reading of the detailed description with appropriate reference to the accompanying drawings.

DETAILED DESCRIPTION OF THE INVENTION

Figure 1:
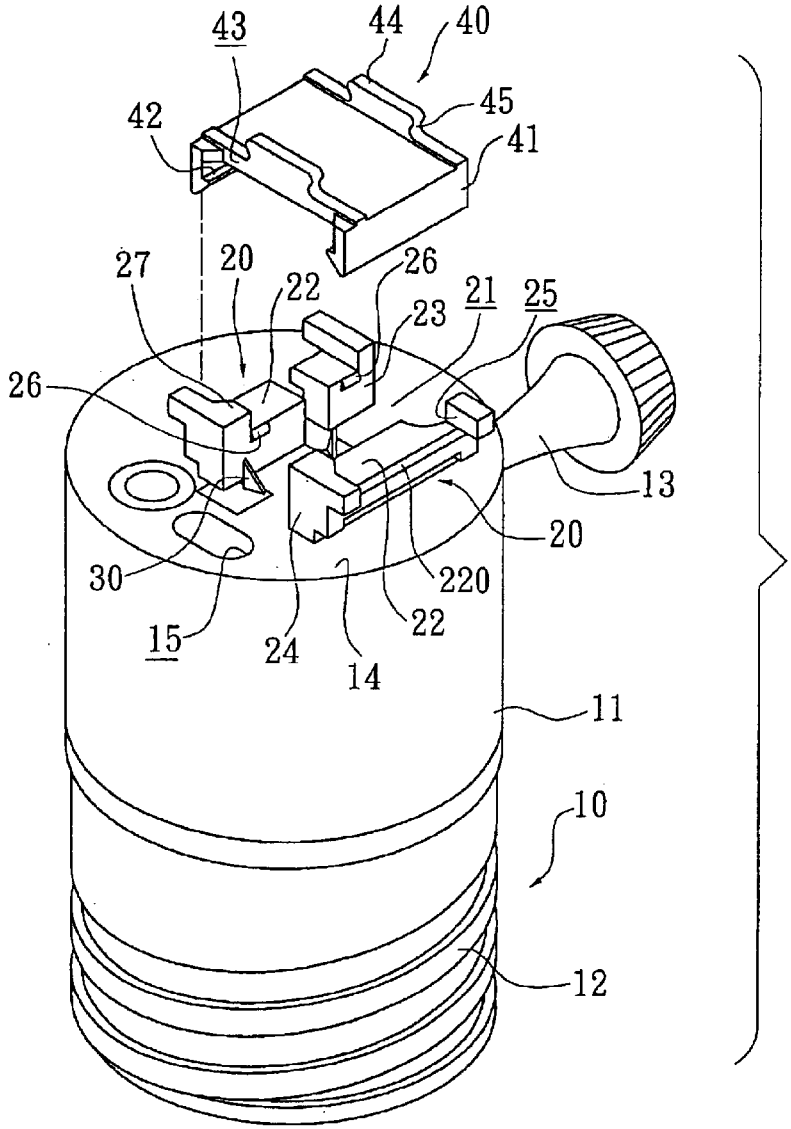
FIG. 1 is a partially exploded perspective view of a wire connect device for a bulb assembly in accordance with the present invention.
Figure 2:
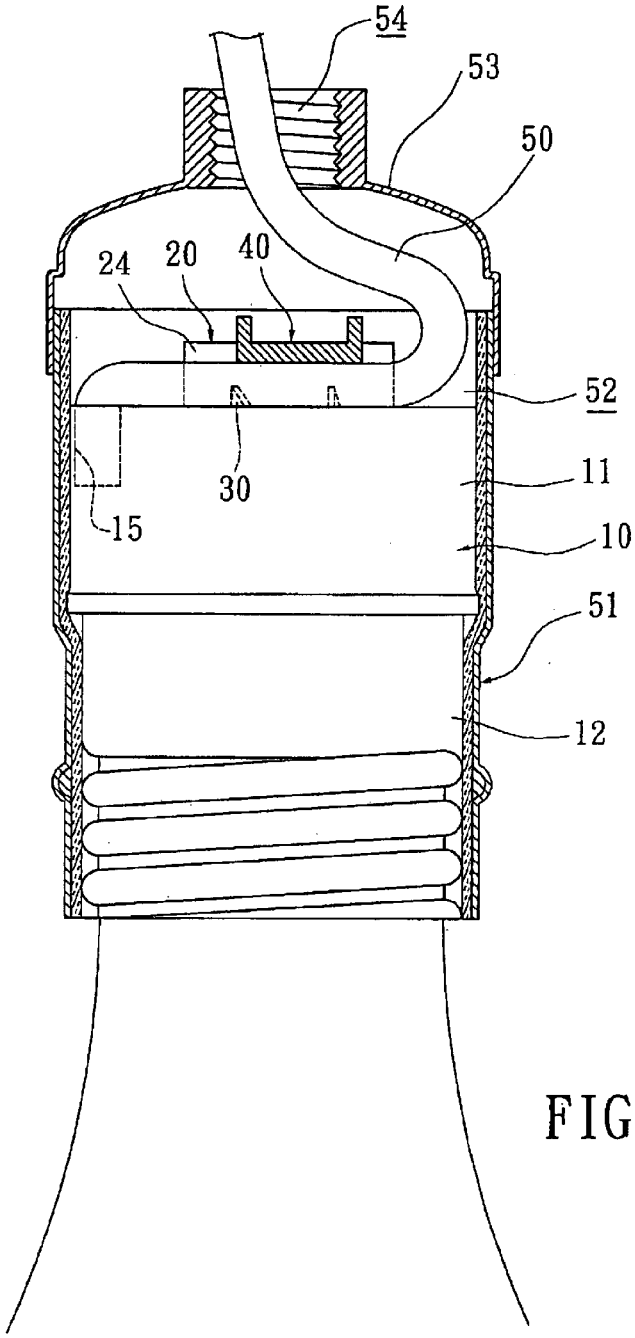
FIG. 2 is a side cross-sectional schematic view of the wire connect device in FIG. 1.
Figure 3:
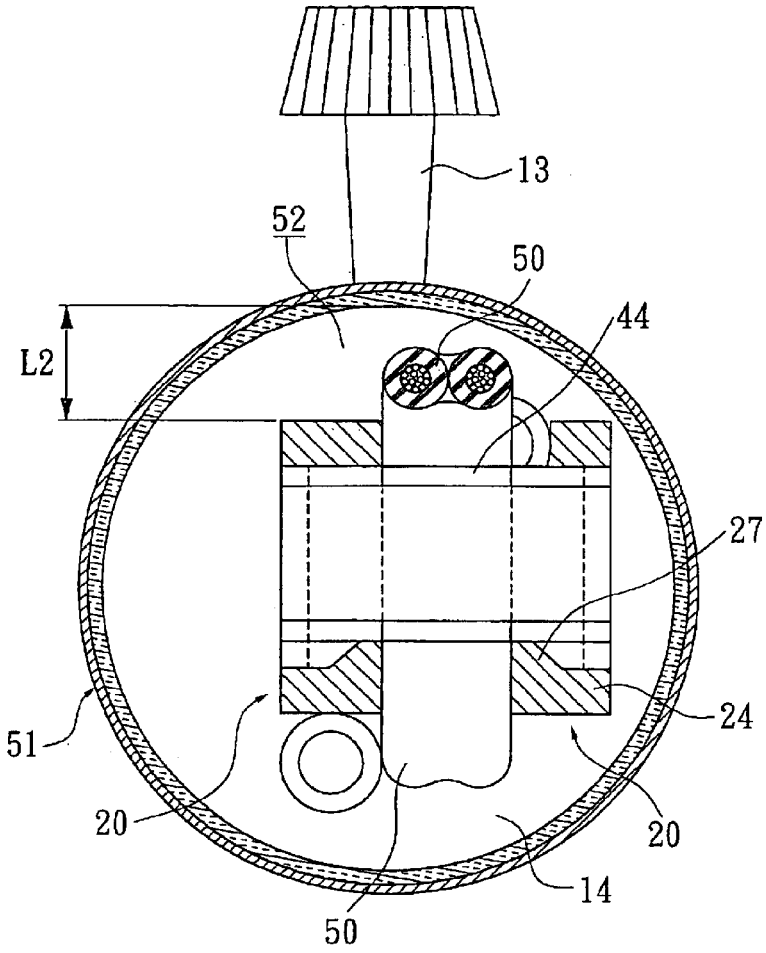
FIG. 3 is a top cross-sectional schematic view of the wire connect device in FIG. 1

Referring to the drawings and initially to FIGS. 1–3, a wire connect device for a bulb assembly in accordance with the present invention comprises a bulb seat (10), two connectors (20) upwardly extending from a plane (14) formed on a top of the bulb seat (10), and a fastener (40) mounted to the two connectors (20) to hold the wire (50) in place.

The bulb seat (10) includes a body (11) and a switch (13) mounted on the body (11) for controlling multiple electric elements (not shown) in the body (11). The body (11) has a screw shell (12) formed opposite to the plane (14) for connected to a bulb (not shown).

The two connectors (20) are rectangular and parallel to each other to form a groove (21) between the two connectors (20). Two electrode plates (30) extend through the plane (14) of the body (11) between the two connectors (20) and are electrically connected to the electric elements in the body (11). A blind hole (15) is longitudinally defined in the plane (14) and linearly corresponds to the groove (21). A distance (L2) between the two connectors (20) opposite to the blind hole (15) and an outer periphery of the body (11) is greater than a diameter of the wire (50). The two connectors (20) respectively have a vertical face (23) formed to define the groove (21) between the two connectors (20) and a horizontal face (22) formed on a top of each of the two connectors (20). Each horizontal face (22) includes an outer side having a slant face (220) formed thereon and the two slant faces (220) opposite to each other. Each connector (20)

includes two opposite ends each having a stopper (24) extending therefrom to define a trough (25) on the top of each of the two connectors (20). The stopper (24) of each of the two connectors (20) near the blind hole (15) has a protrusion (27) extending into the trough (25) in each of the two connectors (20). Each connector (20) has at least one rib (26) laterally extending from the vertical face (23) of each of the two connectors (20). In the preferred embodiment of the present invention, each connector (20) has two ribs (26).

The fastener (40) has an inverse U-shaped structure. The fastener (40) includes two opposite sides each having a snapper (41) downward extending therefrom. Each snapper (41) has a hook (42) inwardly extending therefrom. A cutout (43) is defined in the fastener (40) and corresponds to the protrusion (27) of each of the connectors (20). The fastener (40) includes two buckles (44) upwardly extending therefrom. Each buckles (44) includes two opposite ends each having a concave (45) defined therein for selectively receiving the at least one rib (26) of each of the two connectors (20).

Figure 4:
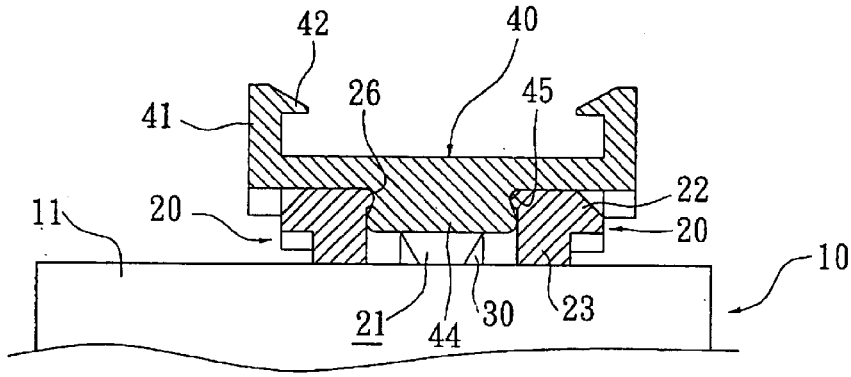
FIG. 4 is a cross-sectional view of the wire connect device of the present invention before mounting the wires.

With reference to FIGS. 1 and 4, the two buckles (44) of the fastener (40) are engaged to the two connectors (20) and the ribs (26) of each of the two connectors (20) are received in the two concave (45) in each of the two buckles (44). Consequently, the method can prevent the fastener (40) from being lost before being connected to the wire (50) or during selling. In the meantime, the two buckles (44) will reinforce the fastener (40) holding the wire when assembled.

Figure 5:
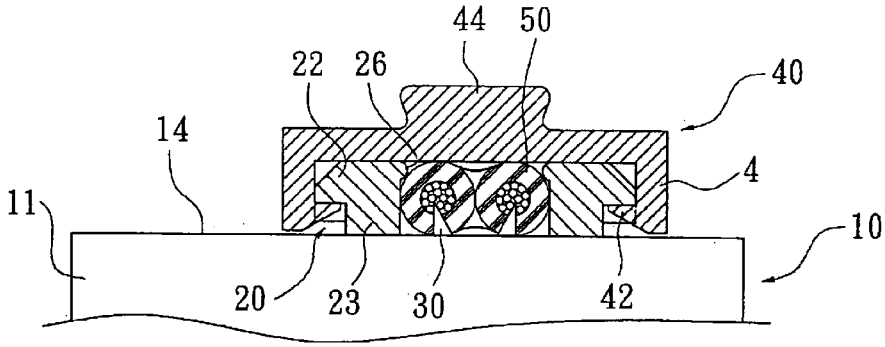
FIG. 5 is a cross-sectional view of the wire connect device of the present invention after being connected the wires.
Figure 6:
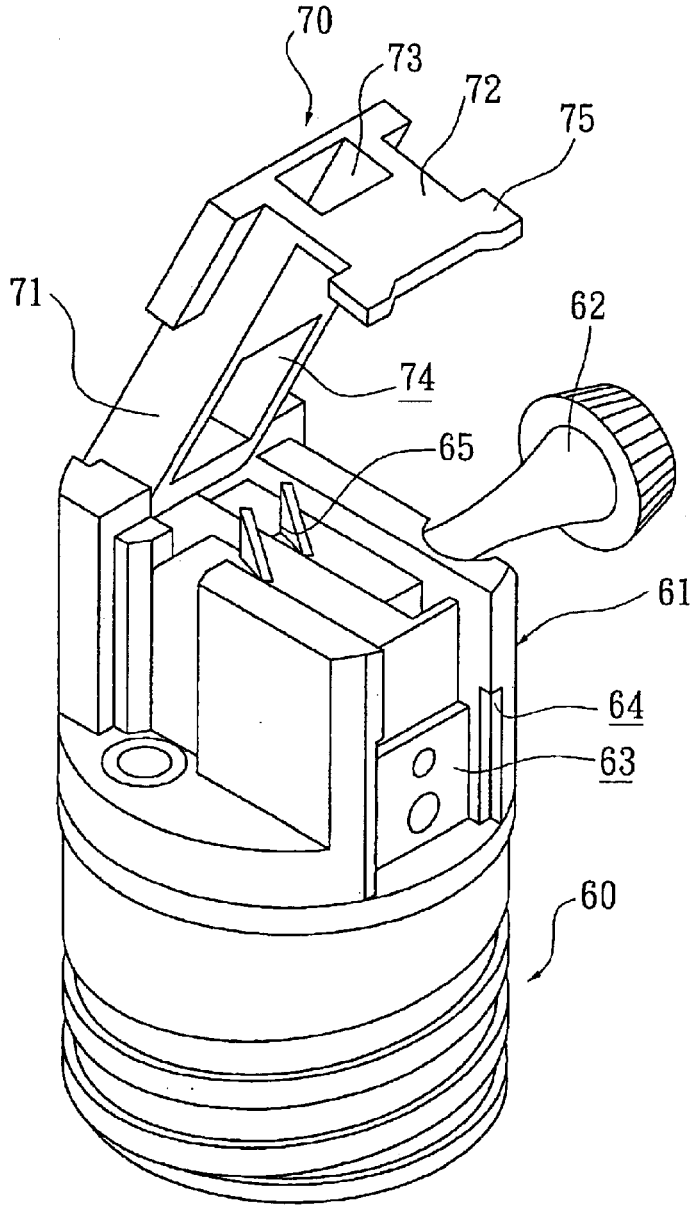
FIG. 6 PRIOR ART
FIG. 6 is a perspective of a conventional wire connect device for a bulb assembly in accordance with the prior art.
Figure 7:
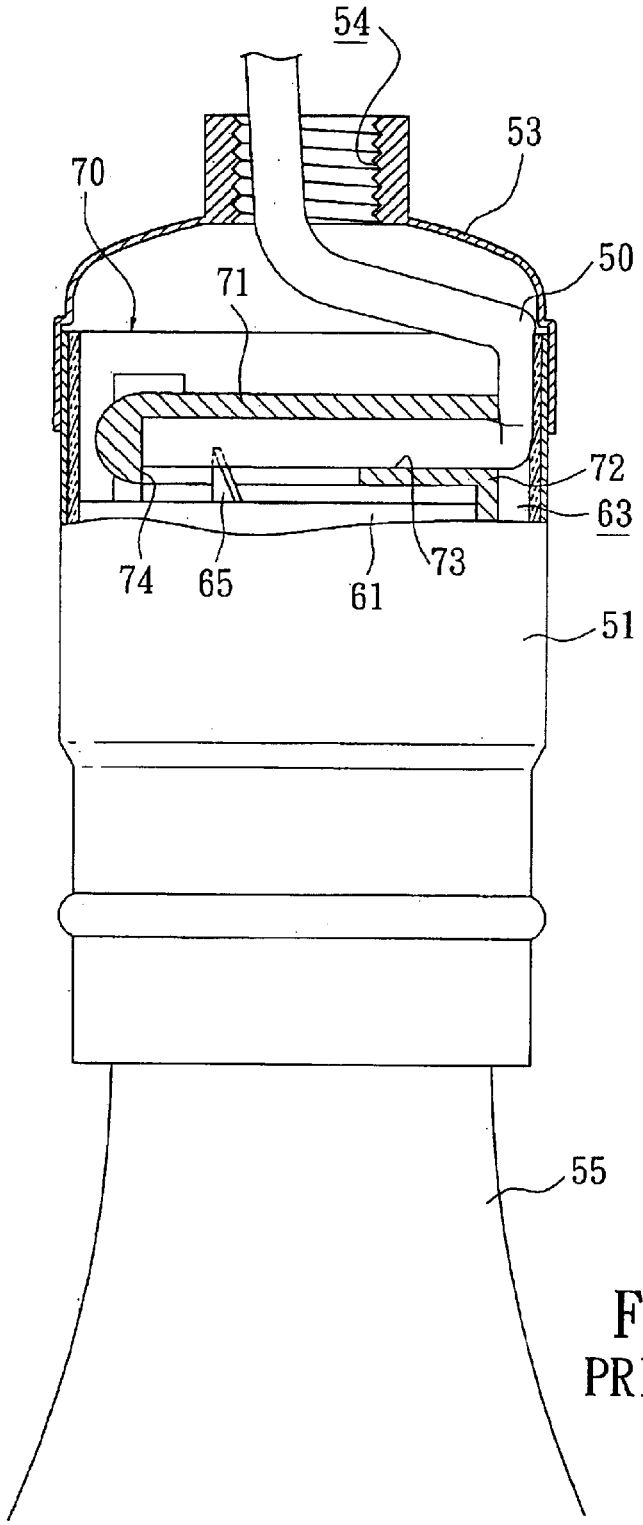
FIG. 7 PRIOR ART
FIG. 7 is a schematic view in cross-section of the conventional wire connect device in FIG. 6.
Figure 8:
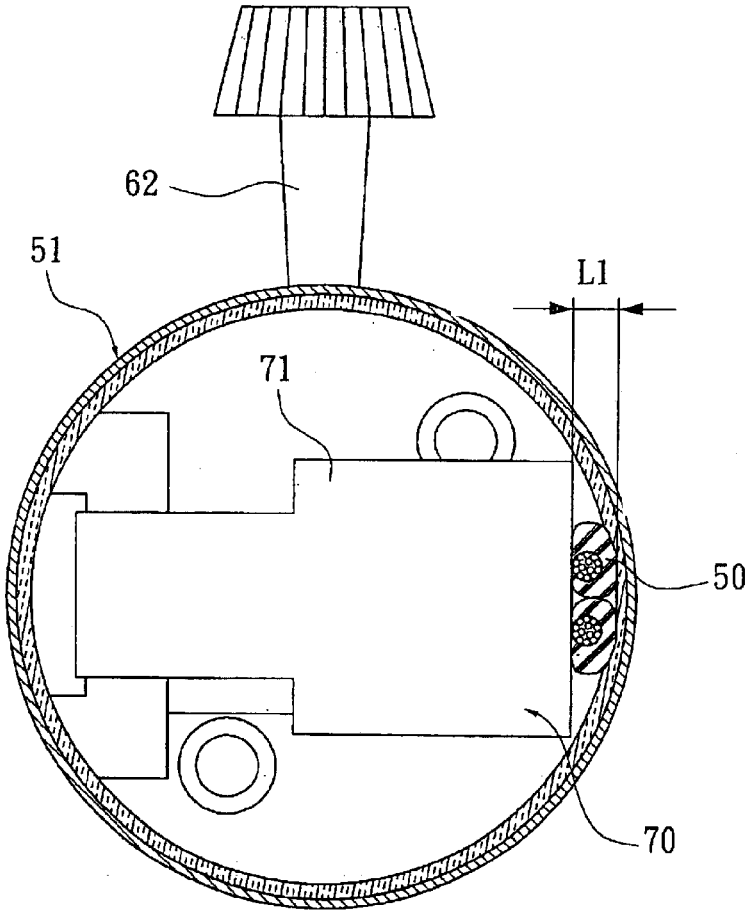
FIG. 8 PRIOR ART
FIG. 8 is a top schematic view in cross-section of the conventional wire connect device in FIG. 6.

With reference to FIGS. 2–3 and 5, the free end of the wire (50) is received in the blind hole (15) after extending through the groove (21). The fastener (40) is mounted to the two connectors (20) to press the wire (50) and make the electrode plates (30) prick through the insulation of the wire (50) such that the wire (50) is positioned and the cores of the wire (50) are respectively electrically connected to the two electrode plates (30). When mounting the fastener (40) to the two connectors (20), each hook (42) slides along a corresponding one of two slant faces (220) to outwardly expand the snappers (41) and the hooks (42) respectively engaged to a bottom of the plane face (22) of each of the two connector (20) and positioned by the two stoppers (24) of each of the two connectors (20). By such a manner, a receiving space (52) between the connectors (20) and a shell (51) of the bulb assembly is greater than that of the conventional bulb assembly. Consequently, the wire (50) can smoothly extends through a through hole (54) in a cap (53) of the bulb assembly.

Before positioning the wire (50) in the groove (21), the free end of the wire (50) is inserted into the bottom of the blind hole (15). It will protect the wire (50) from electric shock, prevent the wire (50) from slipping when being pulled and be easily assembled.

Although the invention has been explained in relation to its preferred embodiment, it is to be understood that many other possible modifications and variations can be made without departing from the spirit and scope of the invention as hereinafter claimed.

What is claimed is:

1. A wire connect device for a bulb assembly, comprising:

a bulb seat including:

a body having a screw shell formed on a first end thereof and a plane formed on a second end opposite to the screw shell; and a switch mounted on the body and adapted to control multiple electric elements in the body;

two connectors upwardly extending from the plane of the body, the two connectors being rectangular and parallel to each other for defining a groove between the two connectors;

two electrode plates extending into the groove and adapted to electrically connected to the multiple electric elements in the body, each electrode plate having a sharpened free end allowing the electrode plates easily prick into the wire and electrically communicating with the cores in the wire, a distance formed between the connectors and an outer periphery of the body being greater than that of a diameter of the wire; and a fastener mounted to the two connectors to hold the wire in place.

2. The wire connect device as claimed in claim 1, wherein:

the two connector respectively have a vertical face formed to define the groove and a horizontal face form on a top of each of the two connectors, each connector having two opposite ends each having a stopper extending therefrom to define a trough in the top of each of the two connectors; and the fastener comprises two opposite sides each having a snapper downward extending therefrom, each snapper having a hook inwardly laterally extending therefrom, wherein the fastener is partially received in the trough in each of the two connectors and the two hooks are respectively engaged to a bottom of the horizontal face of each of the two connectors to hold the fastener in place.

3. The wire connect device as claimed in claim 2, wherein each horizontal face of the two connectors having a slant face formed thereon and opposite to each other, each hook sliding along a corresponding one of the two slant face to outwardly expand the snappers of the fastener.

4. The wire connect device as claimed in claim 2, wherein the stopper of each of the two connectors includes a protrusion extending into the trough and the fastener includes a cutout defined to receive the two protrusions when the fastener is mounted to the two connectors.

5. The wire connect device as claimed in claim 1, wherein each connector comprises two ribs laterally extending from the vertical face of each of the two connectors and the fastener comprises two buckles upwardly extending from the fastener, each buckle including two opposite ends each having a concave defined therein for selectively receiving the ribs of the two connectors.

6. The wire connect device as claimed in claim 1, wherein the bulb seat comprises a blind hole defined in the plane of the body for receiving a free end of the wire.

* * * * *